United States Patent [19]

Grimaldi et al.

[11] 4,275,883

[45] Jun. 30, 1981

[54] PITCHING TARGET WITH BALL RETURN

[75] Inventors: Anthony J. Grimaldi, 25 Mountain View Ave., Kingston, N.Y. 12401; Anthony Fabiano, Kingston, N.Y.

[73] Assignee: Anthony Grimaldi, Kingston, N.Y.

[21] Appl. No.: 82,694

[22] Filed: Oct. 9, 1979

[51] Int. Cl.[3] ..... A63B 61/00

[52] U.S. Cl. ..... 273/26 A

[58] Field of Search ..... 273/26 A, 29 A, 127 R, 273/127 A, 127 B, 127 D, 176 B, 176 D, 176 K, 181 R, 181 A, 181 F, 181 J, 181 K, 82 R, 397, 396, 92 B, 394

[56] References Cited

U.S. PATENT DOCUMENTS

| | | | |
|---|---|---|---|
| 1,869,642 | 8/1932 | Woolman | 273/176 K |
| 1,879,316 | 9/1932 | Kleb | 273/26 A |
| 2,087,575 | 7/1937 | Littell et al. | 273/26 A |
| 2,657,058 | 10/1953 | Mulchay | 273/26 A |
| 2,915,314 | 12/1959 | Phillips | 273/26 A |
| 2,988,360 | 6/1961 | Lambiotte | 273/26 A |
| 3,215,432 | 11/1965 | Lee et al. | 273/29 A |
| 3,810,616 | 5/1974 | Murphy | 273/26 A |
| 3,918,711 | 11/1975 | Zak | 273/26 A |
| 4,083,559 | 4/1978 | Owen, Jr. | 273/26 A |
| 4,118,028 | 10/1978 | Larkin | 273/26 A |
| 4,173,337 | 11/1979 | Okonowski | 273/26 A |

*Primary Examiner*—Richard C. Pinkham
*Assistant Examiner*—T. Brown
*Attorney, Agent, or Firm*—John Maier, III

[57] ABSTRACT

A pitching target with ball return which indicates whether a baseball pitch is either a strike or a ball and, if a strike, the location of the strike, i.e.: outside corner. The ball return includes an inclined ball collecting trough for return of the thrown ball to the pitcher for reuse. The target includes a frame which supports a series of flap panels suspended in the same plane and within the frame. The panels are arranged in three rows and three columns. The panels in the central column are wider in the horizontal dimension than the two outside panels but have the same vertical dimension as the panels on each side thereof.

2 Claims, 5 Drawing Figures

PITCHING TARGET WITH BALL RETURN

BACKGROUND OF THE INVENTION

The present invention relates to a pitching target with ball return and more particularly to a vertically-oriented and vertically adjustable screen including horizontal cords with flaps hung thereon for indicating the location of pitches thrown. A backstop is provided behind the screen for stopping the thrown baseball. A collecting trough is located at the bottom of the backstop. A motorized conveyor unit raises the ball from the collecting trough to a return trough which directs the ball back to the pitcher by gravity.

Various target apparatus are known and disclosed in the prior art.

Examples of United States patents showing such devices are as follows:

| Inventor | Pat. No. |
|---|---|
| Everson | 1,043,308 |
| Lambiotte | 2,988,360 |
| Gaudet | 3,157,399 |
| Vinson | 3,194,556 |
| Murphy | 3,810,616 |
| Larkin | 4,118,028 |

Some of these devices are not suitable for baseball target practice but are more intended as a specialized game of skill in and of themselves. Others are geared toward baseball but lack a means of indicating exactly the pitch thrown as would a trained baseball umpire. No vertical adjustment in the target is available to provide a target capable of simulating the heights of various batters. Others, while possibly overcoming these defects, do so with a complicated and expensive apparatus.

The instant invention provides a complete target practice arrangement for baseball pitchers which not only provides a means for indicating whether the pitch is a ball or a strike but also classifies a strike into various types based on location. In addition thereto, the instant invention does not just collect the baseball but returns it to the pitcher so that he can continually utilize a limited number of baseballs without stopping his practice to go to a collecting area and recover the thrown balls. This is accomplished by means of apparatus which is rugged and durable and comparatively inexpensive to construct and therefore is readily available not only to professional ball players but also for home use and children's groups.

These and various other problems were not satisfactorily resolved until the emergence of the instant invention.

SUMMARY OF THE INVENTION

In accordance with the present invention, there is provided a indicating screen which includes a series of horizontal cords located in a common vertical plane. The cords are mounted on a tubular frame which is adjustable as to height to simulate various size batters and is mounted on skids for easy transportation. Behind the indicator screen, on the side opposite from the pitcher, is a backstop for stopping the thrown ball regardless of whether it is a strike or a ball. A collecting trough is located at the bottom of the backstop. The collecting trough is inclined from the horizontal for gravity feed to one side of the backstop. At the low end of the inclined trough is a motor-driven conveyor unit for lifting the ball upwardly to a return trough which is inclined downwardly toward the location of the pitcher.

The novel features which are considered as characteristic of the invention are set forth with particularity in the appended claims. The invention itself, however, as to its construction and obvious advantages will be best understood from the following description of the specific embodiment when read with the accompanying drawings.

DETAILED DESCRIPTION

Figure 1:
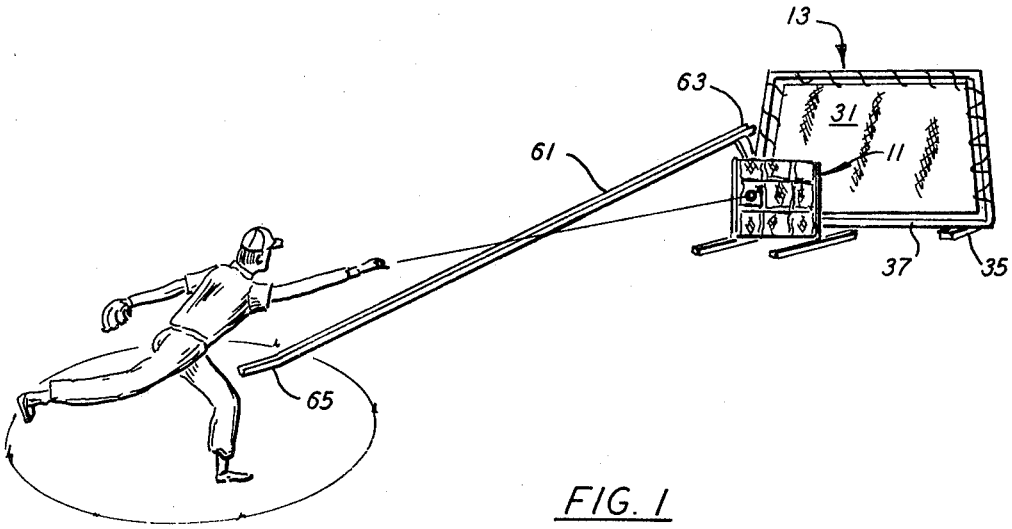
FIG. 1 is a perspective view showing the pitcher, the indicator screen, the backstop and the return trough.

The same reference numerals are used throughout the drawings and specification to note a similar item of the invention.

Figure 3:
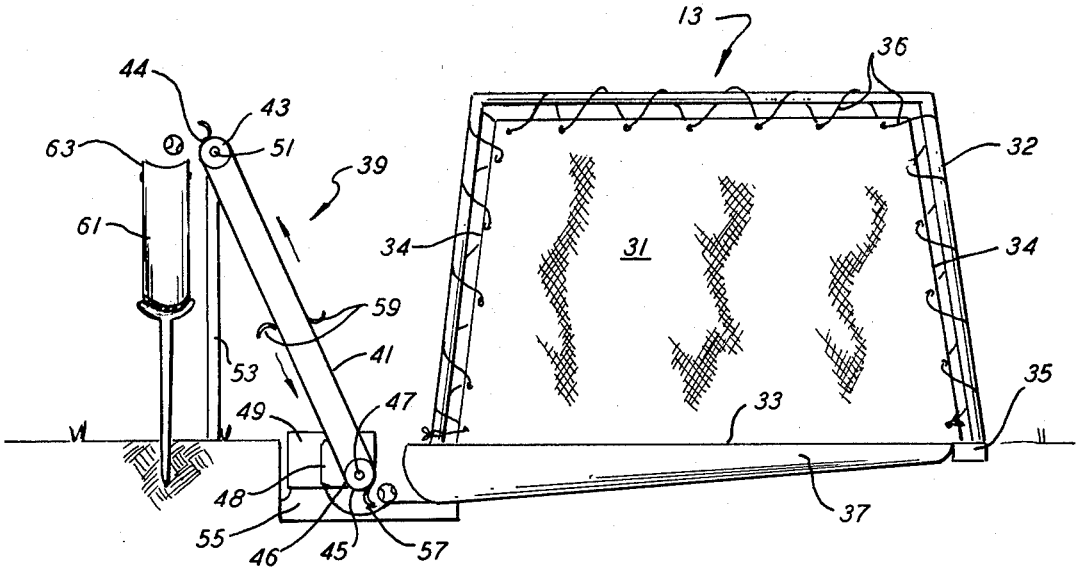
FIG. 3 is a front elevation of the backstop with the trough, conveyor and a portion of the return trough.
Figure 4:
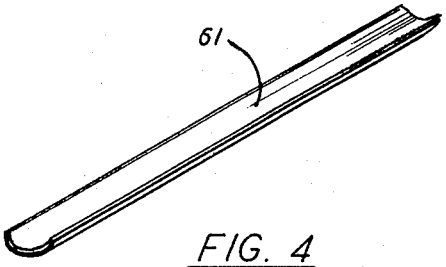
FIG. 4 is a perspective view of the return trough.
Figure 5:
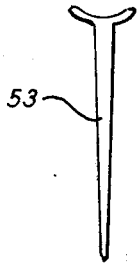
FIG. 5 is a front elevation of the supports for supporting the conveyor and return trough.

Referring now to FIGS. 1 and 3, there is shown an indicator screen 11 and a backstop 13 located to the rear of it. Both the indicator screen 11 and the backstop 13 are vertically oriented. The indicator screen 11, which is mounted on skids 15, includes a frame 17 having two vertical posts 18 and a horizontal bottom post 19.

Figure 2:
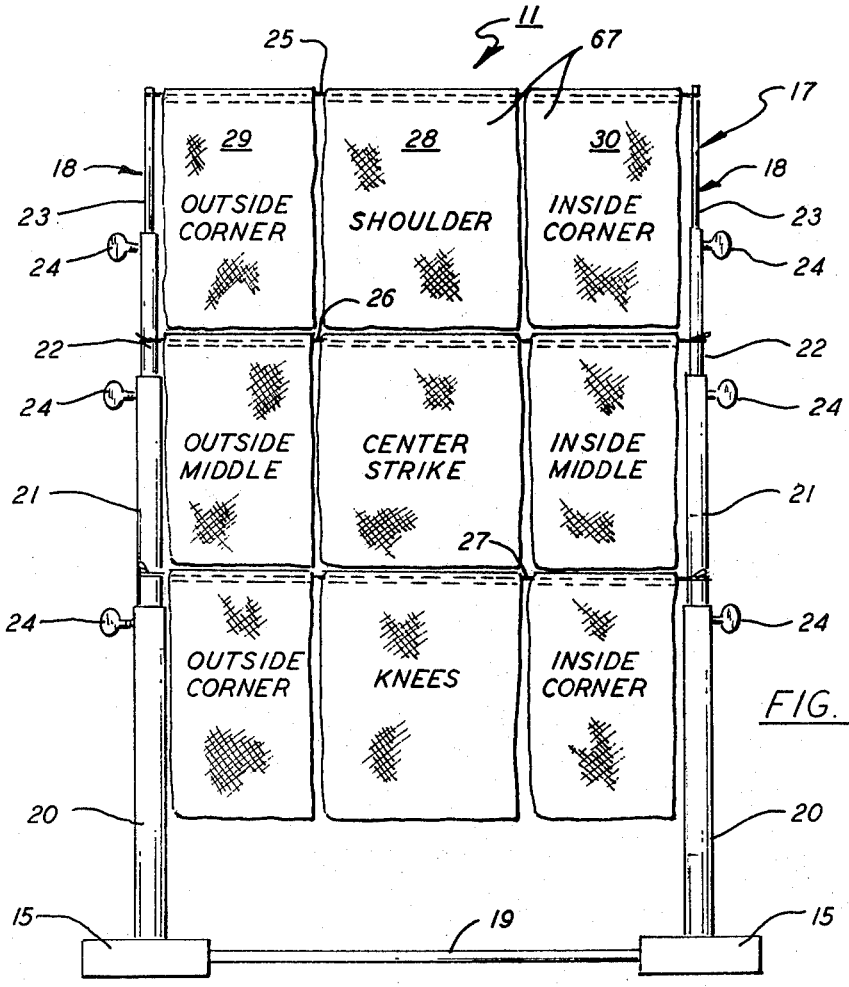
FIG. 2 is a front elevation of the indicator screen with flaps in place.

As best seen in FIG. 2, each of the vertical posts 18 is adjustable in a vertical direction by the telescoping relationship of a base tube 20, a lower intermediate tube 21, an upper intermediate tube 22, and a top tube 23. Thumb screws 24 are provided in the base tubes 20 and the lower and upper intermediate tubes 21, 22 for engaging the lower intermediate tubes 21, an upper intermediate tube 22 and the top tube 23, respectively, thereby locking the vertical posts 18 in the desired vertical position. A series of three horizontal cords, namely a top horizontal cord 25, an intermediate horizontal cord 26 and a bottom horizontal cord 27, either strings or wires, are located equally distance from one another (preferably eight inches apart from one another) and all within the same plane. On each of the horizontal cords 25, 26, 27 a series of three rectangular flaps are vertically hung from the top of the flap, the center flap 28 being horizontally larger than the left side flap 29 and the right side flap 30 which have substantially the same horizontal dimension. All three flaps 28, 29, 30 have a vertical dimension of eight inches but the left and right flaps 29, 30 preferably have a horizontal dimension of five inches. Each center flap 28 has a horizontal dimension of seven inches. As a result, all three center flaps 28 have a larger area and are located between all three left flaps 29 and all three right flaps 30. Both the right flaps 30 and the left flaps 29 have the same area. All of the center flaps 28 are vertically aligned with one another as are the right flaps 30 and the left flaps 29.

Each of the flaps 28, 29, 30 located on all three horizontal cords 25, 26, 27 is hung from the top and is of a pliable and flexible material so as to swing out when struck by a baseball thereby permitting the baseball to pass through the indicator screen 11.

The indicator screen 11 may be move up and down to simulate the strike zone for a tall or short batter and the flaps will still operate properly. The flaps 28, 29, 30 are sized to provide the greatest flexibility for movement of the vertical posts 18 up and down.

The backstop 13 is located substantially parallel to the indicator screen 11 on the side of the indicator screen 11 remote from the pitcher. The backstop 13 is larger than the indicator screen 11 so as to be capable of stopping even wild pitches that might miss the indicator screen 11 entirely. The backstop 13 includes a canvass 31 supported on a tubular frame 32. The backstop 13 has a lower edge 33 and two side edges 34. The backstop 13 is mounted on skids 35. The canvass 31 is held on the tubular frame 32 by a wound string 36 located at the outer edge of the canvass 31 and which is wrapped around the tubular frame 32 of the backstop 13. In front of and adjacent the backstop 13 toward the indicator screen 11, a collecting trough 37 is located. The collecting trough 37 which is a concave elongated member is inclined toward one side of the backstop 13. Baseballs striking the backstop 13 drop into the collecting trough 37 and roll, in accordance with the incline of the collecting trough 37, to the side edge 34 of the backstop 13. At the side edge 34 of the backstop 13 toward which the collecting trough 37 is inclined, is located a motor-driven conveyor unit 39. This conveyor or means unit 39 includes a conveyor belt 41 which is mounted on an upper pulley 43 located at an upper end 44 of the conveyor unit 39 and a lower pulley 45 located at a lower end 46 of the conveyor unit 39. The lower pulley 45 is mounted on a drive shaft 47 of a gear reduction assembly 48 driven by a drive motor 49. The upper pulley 43 is rotatably mounted on a shaft 51 which is held off the ground substantially above the lower pulley 45 by a support structure 53. Preferably, the upper end 44 of the conveyor belt 41 where the upper pulley 43 is located, is five or six feet above the ground level. The drive motor 49 located at the lower end 46 of the conveyor belt 41 is also held in place by a motor support structure 55 which includes a collecting area 57 below the lower pulley 45 which collecting area 57 is directly connected to the end of the collecting trough 37 to receive the baseballs directly from the collecting trough 37. The conveyor belt 41 rotates about in a counter clockwise fashion if located as shown in the drawing or clockwise if located on the opposite edge of the backstop 13. Cups 59 are mounted on the outside of the conveyor belt 41 which swing around with the conveyor belt 41. As the conveyor belt 41 rotates, the cups 59 engage the baseballs as they collect in the collecting area 57. In this way, each cup 59, after receiving the baseball, lifts the baseball upwardly along the conveyor belt 41. As the conveyor belt 41 is inclined from the vertical, as best seen in FIG. 3, the balls fall out of the cups after passing over the upper pulley 43.

A return trough 61 serves to return the baseball to the pitcher. The return trough 61 has an upper end 63 and a lower end 65 and is inclined downwardly from the upper end 63 to the lower end 65. The upper end 63 of the return trough 61 is located off the ground at substantially the same distance as the upper end 44 of the conveyor belt 41 and the upper end 63 of the return trough 61 is adjacent the upper end 44 of the conveyor belt 41. The upper end 63 of the return trough 61 is also supported off the ground by a support structure 53. As a baseball moves up the conveyor belt 41 within a cup 59 and reaches the upper end 44 of the conveyor belt 41, it is then dropped over into the return trough 61 due to the conveyor belt 41 being inclined at an angle from the vertical. The cup 59, after having dropped the baseball into the return trough 61, then proceeds downwardly back to receive another baseball, if available. The return trough 61 being elevated five or six feet above the ground provides a sufficient gravity feed to return the baseball back to the pitcher. The return trough 61 preferably has sufficient length to cause the baseball to roll out of the return trough 61 adjacent the pitcher as seen in FIG. 1.

As best seen in FIG. 2, the indicator screen 11 has a total of nine rectangular areas, each formed by one of the flaps 28, 29, 30, each of which has been labeled to show the type of strike which would be achieved from a ball passing through it. As the ball goes forward, it hits the flap 67, passes through it and then strikes the backstop 13. The movement of the flap 67 assures the pitcher that he will know exactly where his pitches have gone. Pitches which do not strike one of the flaps 28, 29, 30 are all considered balls.

The present invention may be embodied in other specific forms without departing from the spirit or essential characteristics thereof. The present embodiments are, therefore, to be considered in all aspects as illustrative and not restrictive. The scope of the invention is indicated by the appended claims rather than the foregoing description and all changes which come within the meaning and range of equivalency of the claims are, therefore, intended to be embraced therein.

We claim:

1. A pitching target with ball return for practice by a pitcher in pitching baseballs comprising:

a vertically-oriented pitching indicator including a frame and three horizontal cords all located within the same plane and mounted on the frame, said frame being adjustable in height to relocate separately the height of each horizontal cord;

three flaps hung on each of the three horizontal cords, each group of three flaps including a left flap, a right flap and a center flap, each center flap being located between the right and left flaps, all of the right flaps being vertically aligned with one another, all of the center flaps being vertically aligned with one another, all of the left flaps being vertically aligned with one another, all of the left and right flaps having substantially the same area, all of the center flaps having substantially the same area and being larger in area than the left and right flaps, all of the center and left and right flaps having the same vertical dimension;

a backstop including a frame with a canvass mounted therein, said backstop being substantially parallel to and spaced from said pitching indicator, said backstop having a lower edge and two side edges;

a collecting trough including a concave elongated member located adjacent the lower edge of said backstop toward said indicator screen and adapted to receive baseballs hitting said backstop, said collecting trough being inclined toward one side edge of said backstop;

a conveyor means having an upper end and a lower end, said lower end of said conveyor means being located adjacent the lower end of said collecting trough, said conveyor means including a conveyor belt mounted on an upper pulley and a lower pulley, said upper pulley being located substantially above said lower pulley, said conveyor belt having a plurality of cups mounted thereon and adapted to receive baseballs from the collecting trough, said conveyor means being inclined at an angle from the vertical;

a motor means for driving said conveyor means; and a return trough having an upper end and a lower end, said upper end being located adjacent to the upper end of said conveyor means and adapted to receive baseballs from the cups on the conveyor belt, said return trough being extended to the pitcher, said upper end of said return trough being substantially above said lower end of said return trough.

2. A pitching target according to claim 1 wherein each flap has written on it a particular type of pitch of a baseball thrown by the pitcher.

* * * * *